US005487812A

United States Patent [19]

Thornton et al.

[11] Patent Number: 5,487,812

[45] Date of Patent: Jan. 30, 1996

[54] TREATMENT OF ALKALINE BLEACHED MECHANICAL WOOD PULP WITH PECTINASE

[75] Inventors: Jeffrey W. Thornton; Christer S. Eckerman; Rainer O. Ekman; Bjarne R. Holmbom, all of Åbo, Finland

[73] Assignee: Mesta-Serla Oy, Mantta, Finland

[21] Appl. No.: 294,876

[22] Filed: Aug. 23, 1994

Related U.S. Application Data

[63] Continuation of Ser. No. 874,867, Apr. 28, 1992, abandoned.

[30] Foreign Application Priority Data

May 2, 1991 [FI] Finland ..... 912136

[51] Int. Cl.[6] ..... D21C 3/00

[52] U.S. Cl. ..... 162/72; 162/65; 162/78; 162/190; 435/277; 435/278

[58] Field of Search ..... 162/72 B, 78, 162/65, 190, 60, 83; 435/275, 276, 277, 278

[56] References Cited

U.S. PATENT DOCUMENTS

| | | | |
|---|---|---|---|
| 4,617,383 | 10/1986 | Jaskowski | 435/275 |
| 4,687,745 | 8/1987 | Farrell | 162/72 B |
| 4,891,096 | 1/1990 | Akkawi | 162/72 B |
| 4,964,955 | 10/1990 | Lamar et al. | 162/164.6 |

FOREIGN PATENT DOCUMENTS

| | | | |
|---|---|---|---|
| 262040A | 9/1986 | European Pat. Off. . | |
| 0395792 | 11/1990 | European Pat. Off. . | |
| 2641803 | 7/1990 | France . | |
| 2-118191 | 5/1990 | Japan . | |
| 9105908 | 2/1991 | WIPO . | |
| 9111553 | 8/1991 | WIPO | 162/76 |

OTHER PUBLICATIONS

Pilon et al. "Increasing Water Retention of Mech. Pulp by Biological treatment," Tappi, Jun. 1982, pp. 93–96.

Paice, M. G & Jurasek, L., "Removing Hemicellulose from Pulps By Specific Enzyme Hydrolysis", International Conference, London 1983.

*Primary Examiner*—David L. Lacey
*Assistant Examiner*—Dean T. Nguyen
*Attorney, Agent, or Firm*—Banner & Allengretti, Ltd.

[57] ABSTRACT

The present invention relates to a method of making paper from bleached or alkaline treated pulp by dewatering pulp containing bleached or alkaline treated vegetable fibers from wood or non-wood species. It was found that such bleached or alkaline treated pulps contain a substantial amount of harmful pectins. By incorporating pectinase in the bleached or alkaline treated pulp such harmful pectins in the aqueous phase of the pulp are degraded and thus rendered harmless to papermaking processes.

9 Claims, 7 Drawing Sheets

TREATMENT OF ALKALINE BLEACHED MECHANICAL WOOD PULP WITH PECTINASE

This application is a continuation of application Ser. No. 07/874,867, filed Apr. 28, 1992 now abandoned.

FIELD OF THE INVENTION

The present invention relates to treatment of pulp for use in papermaking and, especially, to an improvement in making paper from alkaline treated pulp by dewatering a pulp containing alkaline treated vegetable fibers.

DESCRIPTION OF RELATED TECHNOLOGY

Pulping techniques commonly used today include chemical, semichemical, chemimechanical, and mechanical pulping of different wood materials, including softwood and hardwood, as well as non-wood materials such as bagasse, hemp, kenaf, bamboo, etc. Various additives are used in order to improve the quality of the paper obtained as well as the economy of the papermaking and pulping processes.

The Japanese published patent application 2-118191 by Jujo Paper Company, Limited discloses treating mechanical pulp with pectinase in order to degrade pectins on the fibers thus weakening the bond between lignin and cellulose and further refining the pulp before bleaching. It is alleged that this treatment will improve the brightness of the mechanical pulp by facilitating removal of lignin from the surface of the fibers during subsequent refining of the pulp.

Finnish Patent Specification 85041 discloses a process for treating water separated from an untreated (unbleached) mechanical pulp/water suspension in the production of paper, with a hemicellulose enzyme in order to degrade substances dissolved or dispersed from the fibers. The enzyme treated water is then recirculated to be re-used for slurrying new pulp fed to the system. FI 805041 also suggests using enzymes other than hemicellulases, such as cellulases, esterases or pectinases, but no specific or experimental disclosure with respect to these other enzymes.

SUMMARY OF THE INVENTION

It has now been surprisingly found that the aqueous phase of alkaline treated pulp contains a substantial amount of pectins irrespective of whether pectin degrading pectinases have been added to the pulp before the alkaline treatment or not. It has been observed that alkaline treatment such as bleaching, particularly alkaline peroxide bleaching, will effectively release pectins from the fiber phase into the aqueous phase of a mechanical pulp. No significant amounts of pectins have been found in the aqueous phase of unbleached mechanical pulps. Treating unbleached pulps with pectinase, as suggested in the above Japanese publication, did not prevent pectins from later being released from the fibers upon bleaching. This may be because the enzymes are not accessible to the pectins that are released upon bleaching since the enzymes may be sterically hindered from penetrating deep within the fiber structure where pectins are also located. Accordingly, pectins were present in substantial amounts in the aqueous phase of bleached pulps even when pectin degrading pectinases were added prior to bleaching. Active pectinases added to the pulp before bleaching were found to be destroyed by the severe conditions prevailing in bleaching and therefore were not able to degrade those pectins released in bleaching. Degradation of the enzymatically active pectinases is probably caused by high temperature, bleaching agent, degradation products of the bleaching agent, as well as high pH.

It is known that carbohydrates, like pectins, present in the aqueous phase of alkaline treated pulp will have negative effects on the dewatering rate of the pulp in paper making and the quality of the paper obtained. The negative effects are due to the fact that pectins are polymeric substances, making dewatering cumbersome, and that anionic pectins will form complexes with cationic papermaking polymers, including cationic retention aids used to improve retention of fines and filler in the paper sheet. These cationic papermaking polymers are known to be consumed by such anionic polymers, rendering the cationic polymers less effective in retaining fines and filler materials in the paper. Artionic polymers, such as pectins, have been commonly referred to as anionic trash.

The object of the present invention is thus to provide an improved method of making paper from pulp containing alkaline treated vegetable fibers. According to the present invention this improvement is achieved by incorporating pectinase in the alkaline treated pulp to decompose any pectins in the aqueous phase of the pulp. The present invention is useful in making paper from any pulps including chemical, semichemical, chemimechanical and mechanical pulps containing any type of vegetable fibers, including wood and non-wood fibers, and treated at alkaline conditions or bleached by any bleaching method using such bleaching agents as alkaline hydrogen peroxide, oxygen or sulfite.

The term "pulp" refers to an aqueous mixture of vegetable fibers in which the water content can vary within a very wide range and which in addition to fibers can also contain additives such as fillers and retention aids.

The term "incorporating pectinase" in this context simply means that pectinase should be present in the aqueous phase of the pulp after the alkaline treatment such as bleaching and before dewatering the bleached pulp.

Although the present invention essentially improves the dewatering properties of any pulp containing bleached vegetable fibers, it is especially useful for treating such pulps that in addition to bleached vegetable fibers also contain cationic retention aids used to improve retention of fines and filler in the sheet since anionic trash, such as pectins, are known to render these less effective in retaining filler materials in the paper.

The pectinase is preferably added to the alkaline treated pulp at such an early stage as to allow the pectinase to substantially degrade the pectins in the aqueous phase of the alkaline treated pulp before adding said retention aids.

Although the effective amount of pectinase to be added to bleached pulps in order to obtain the objectives of the present invention may vary within a large range depending upon the specific pectinase used and the bleached pulp to be treated, the man skilled in the art will find no difficulties in establishing the optimal amount of pectinase, as calculated on dry pulp, in each case by using standard procedures well known in the art and thus without undue experimentation. For example when using a pectinase mixture containing polygalacturonase (EC 3.2.1.15) and pectin methylesterase (EC 3.1.1.11) in the treatment of a thermo-mechanical pulp of spruce from alkaline peroxide bleaching, an amount of 0.4% to 4% of pectinases, calculated on dry pulp, was found sufficient.

In the treatment of the present invention it is sufficient to add the pectinase to the aqueous phase of the alkaline treated pulp. It should be noted that the treatment of the present invention will not significantly affect pulp yield because the treatment concentrates on pectins that have already been dissolved from the pulp fibers. Accordingly, it is also possible to add the pectinase to either wash water obtained from washing alkaline treated pulp or to water obtained in dewatering the alkaline treated pulp in papermaking.

Pulp washing is gaining popularity in mills utilizing peroxide bleaching of mechanical pulps because of the observed negative effects peroxide bleaching has on papermaking, which now, unexpectedly, has been found to be due to the pectins released in peroxide bleaching. Pulp washing is carried out in order to remove water containing dissolved and colloidal substances from the bleached pulp. Mills utilizing pulp washing have to find ways to treat the dirty water prior to reusing it in their pulp mill system. It should also be noted that substances other than pectins are found as dissolved and colloidal substances in mechanical pulp suspensions. One type of internal treatment method may include flocculation using a cationic polymer, followed by mechanical removal of the flocculated material. The enzyme treatment of the present invention will thus result in more efficient use of the cationic flocculant by preventing its consumption by the anionic pectins.

White water is the water remaining after making the paper sheet. This water is always reused for diluting new pulp fed to the paper machine to obtain the proper consistency prior to forming the sheet. Fresh water is added to the paper machine when it is necessary to make up for water losses caused by sewering some of the dirty white paper. Pectins have an effect on the drainage properties of pulp suspensions, especially when large amounts buld up in highly closed papermaking systems, i.e. systems utilizing small amounts of fresh water make-up in the paper manufacturing process. At high concentrations, pectins are known to have a jelly forming capability, greatly increasing the viscosity of the aqueous solution. Treating the white water from a paper machine will prevent the pectins from building up in highly closed pulp systems and will result in better drainage properties of pulp fed to the machine. This will result in greater water removal in the wet end of the paper machine, and hence, less steam required to further dry the sheet, which is an important advantage because steam costs are one of the most substantial operational costs of a paper machine.

The present invention is especially useful in the treatment of mechanical pulps bleached at alkaline conditions since high pH has been found to effectively release pectins into the aqueous phase of the pulp. The present invention is also especially useful in treating bleached pulp from non-wood raw materials such as bagasse, hemp, kenaf, bamboo, etc., since such non-wood materials contain much more pectins than wood materials and thus will cause a substantially greater release of pectins into the aqueous phase of the bleached pulp thus produced.

In this context the term "pectinases" refers to any kind of enzymes that are capable of degrading pectins. Especially suitable pectinases are mixtures of polygalacturonases and pectin methylesterases. On the other hand, all major wood species contain some pectins and some non-wood species are very rich in pectins, which are chemically known as polygalacturonic acids or galacturonans.

Thus, in accordance with the present invention it was unexpectedly found that substantial amounts of pectin (polygalacturonic acid) were released from a fiber phase of mechanical pulps in alkaline peroxide bleaching. It was speculated that because of this carbohydrate's anionic nature, that it could significantly consume cationic polymers used as retention aids in paper manufacturing processes. Experiments were conducted to confirm the presence of pectins by treating a bleached pulp suspension with pectinase and analyzing the monosaccharides and total dissolved and colloidal carbohydrates resulting from the treatment. Also, experiments were conducted to determine whether these pectic substances, before and after enzyme treatment, could interact with a cationic polymer used by the paper industry. Finally, experiments were conducted to determine whether treating unbleached pulp with pectinase would prevent the release of pectins upon subsequent peroxide bleaching.

BRIEF DESCRIPTION OF THE DRAWING

The invention is discussed in more detail in the following examples with reference to the enclosed drawings in which.

EXAMPLE 1

Figure 1:
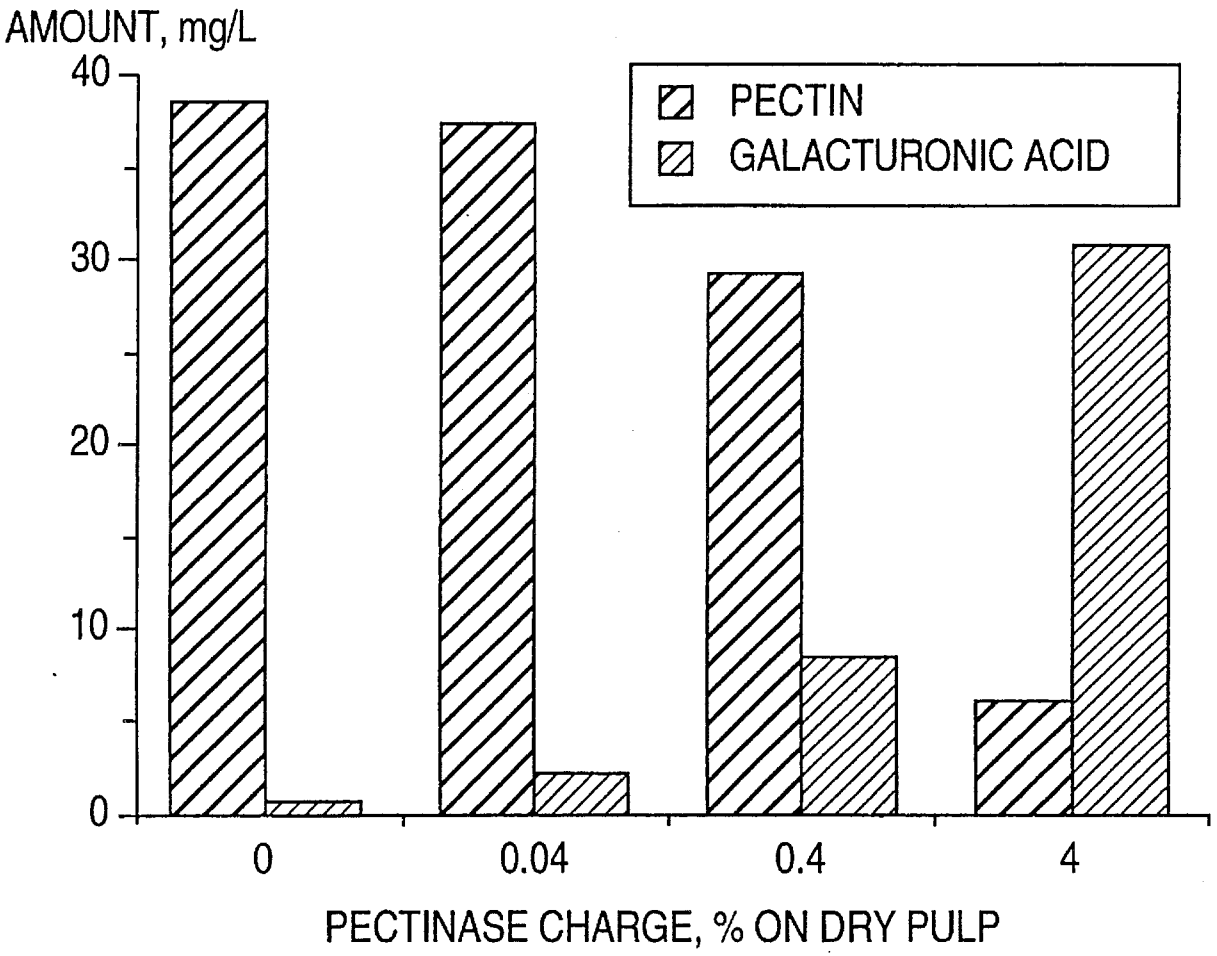
FIG. 1 shows the amount of pectin and galacturonic acid in bleached pulp suspensions treated with various amounts of pectinase.

In this example the cationic demand of pectin and galacturonic acid was determined.

Solutions containing 100 mg/l of Na-polypectate and 100 mg/l of D(+) galacturonic acid were prepared. Thereafter the cationic demand was evaluated by conventional methods by adding a cationic polymer, also known as polybrene, to these solutions. The obtained results are shown in Table I.

TABLE I

| Tested substance | Cationic demand μeq/l |
|---|---|
| Na-polypectate | 472 |
| D(+) galacturonic acid | 1 |

The above results confirm that pectin in water forms complexes with cationic polymers, i.e. consumes cationic polymers, and that an aqueous solution of galacturonic acid does not consume cationic polymers.

Thus, it can be concluded that if pectin can be degraded to monomers, i.e. galacturonic acid, the cationic demand of the system can be eliminated.

EXAMPLE 2

In this example a mechanical pulp, more specifically Norway spruce TMP (thermomechanicl pulp), was used. Peroxide bleaching was carried out with 10 dry g of the TMP sample. After bleaching and acidification, the resulting pulp was diluted to 1% with distilled water and agitated for 3 h. The TMP suspension was then divided into four 250 ml portions. To the four portions, a pectinase mixture containing polygalacturonase (EC 3.2.1.15) and pectin methylesterase (EC 3.1.1.11) and having an activity of 0.007 U/mg was added in the following amount: 0, 0.04, 0.4, 4.0% on dry pulp (U is defined as the number of μmoles of galacturonic acid that can be released from polygalacturonic acid per min at pH 4–5 and 50° C.). The four suspensions were then agitated for 1 h at 50° C. and 500 $min^{-1}$ with a magnetic stirrer. The pH was at its normal value of about pH 5. Half of each suspension was then removed and centrifuged to obtain dissolved and colloidal substances (DCS) samples.

The amount of pectin and galacturonic acid in each sample was evaluated. The obtained results are shown in FIG. 1.

FIG. 1 shows that the total amount of pectin and galacturonic acid remained fairly constant at increased pectinase charges. However, galacturonic acid was clearly formed in increasing amounts with increased pectinase charges. These results show that pectin present in the bleached pulp suspension was degraded, ultimately to galacturonic acid, upon treatment with pectinase.

EXAMPLE 3

To 100 ml of each of the remaining four suspensions in Example 2, was added 5 mg of a cationic polymer known as poly-DMDAAC or polydimethylallylammonium chloride per dry g pulp and allowed to react for 15 min under gentle agitation (250 $min^{-1}$). The suspensions were then centrifuged under normal conditions to obtain DCS samples (dissolved and colloidal samples). All of the DCS samples were frozen immediately upon sampling to prevent residual enzyme from further reacting with any remaining pectic material. Carbohydrate and monosaccharide analyses were performed on each of the four DCS samples. Total organic carbon (TOC) was used to measure the amount of organic DCS in the DCS samples.

Figure 2:
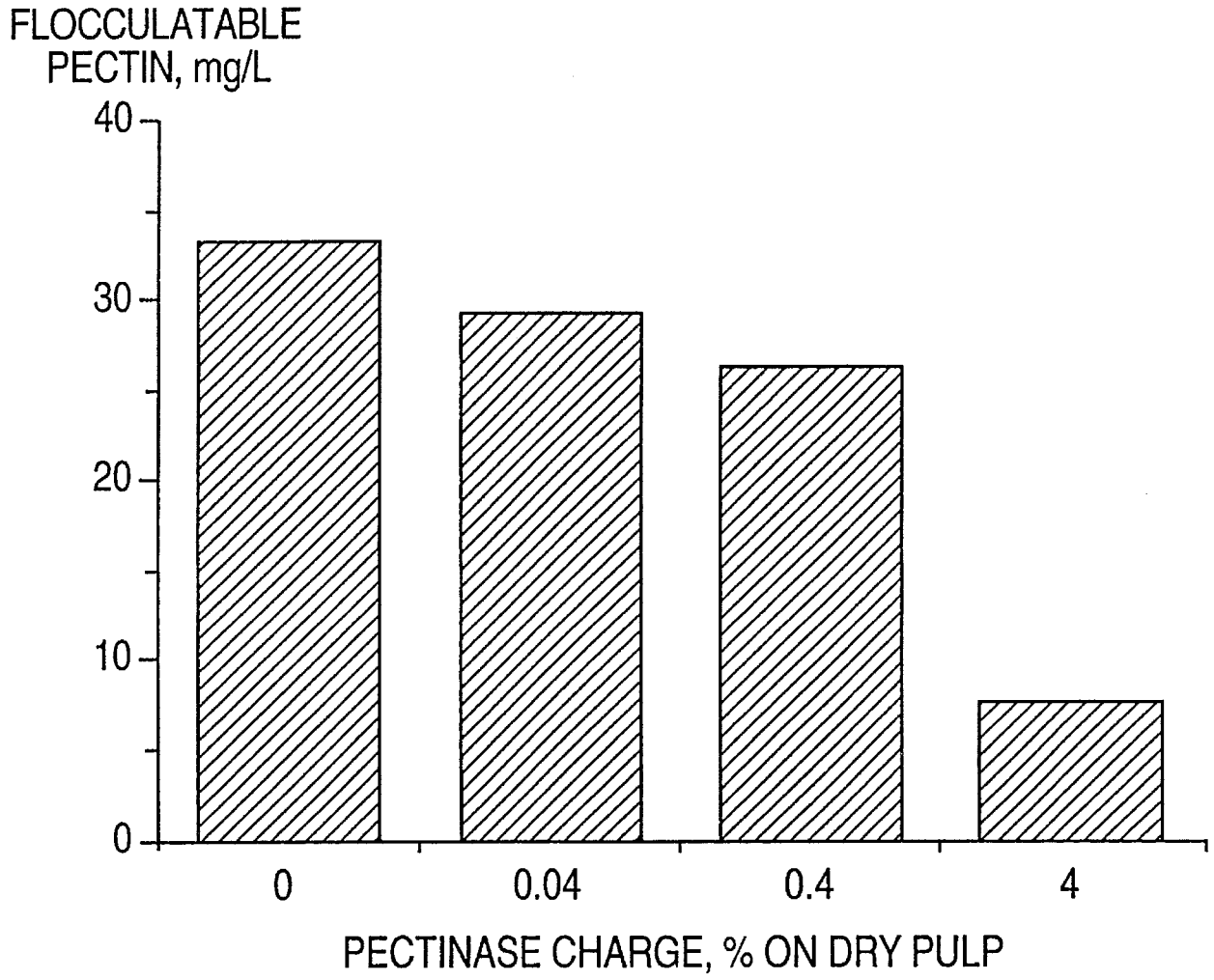
FIG. 2 shows the amount of pectin flocculatable by a cationic polymer added to the pulp at 0.5% on dry pulp.

The amount of flocculatable pectin in each sample was evaluated. The obtained results are shown in FIG. 2.

It can be seen that most of the original pectin in the aqueous phase of the bleached pulp was flocculated and centrifuged away upon addition of the cationic polymer. However, this effect was reversed upon treatment with pectinase. This was probably due to depolymerization of pectins by the pectinase. As the pectins were depolymerized (Example 2, FIG. 1), they became less able to form polyelectrolyte complexes with the cationic polymer. Upon degrading the pectins to monomeric galacturonic acid, the flocculation of pectins with the cationic polymer decreased considerably. It was observed that monomeric galacturonic acid did not form noticeable complexes with the cationic polymer used in this example.

EXAMPLE 4

Unbleached TMP was diluted to 1% with distilled water and agitated for 3 h. The same pectinase (4% on dry pulp) as used in Example 2 was then added and allowed to react with the pulp under the same conditions used for the bleached pulp in Example 2. The resulting slurry was then divided into two parts. The first part was centrifuged to obtain a DCS sample. The second part was bleached with a standard peroxide bleaching solution at 1% consistency and centrifuged to obtain a DCS sample. Carbohydrate and monosaccharide analyses were performed on both DCS samples. As a comparison to these values, a DCS sample was taken from unbleached pulp and analyzed for carbohydrates and monosaccharides. The possible sources of dissolved and colloidal galacturonic acid include mono- and polymeric galacturonic acid (also known as polygalacturonic acid or pectin), as well as galacturonic acid units located on other polysaccharide chains. For Norway spruce, most of the carbohydrates present are as dissolved substances. Monosaccharides (and some disaccharides) can be analyzed in order to differentiate between monomeric galacturonic acid (or simply galacturonic acid) and galacturonic acid bound to other carbohydrate units (including polygalacturonic acid).

Figure 3:
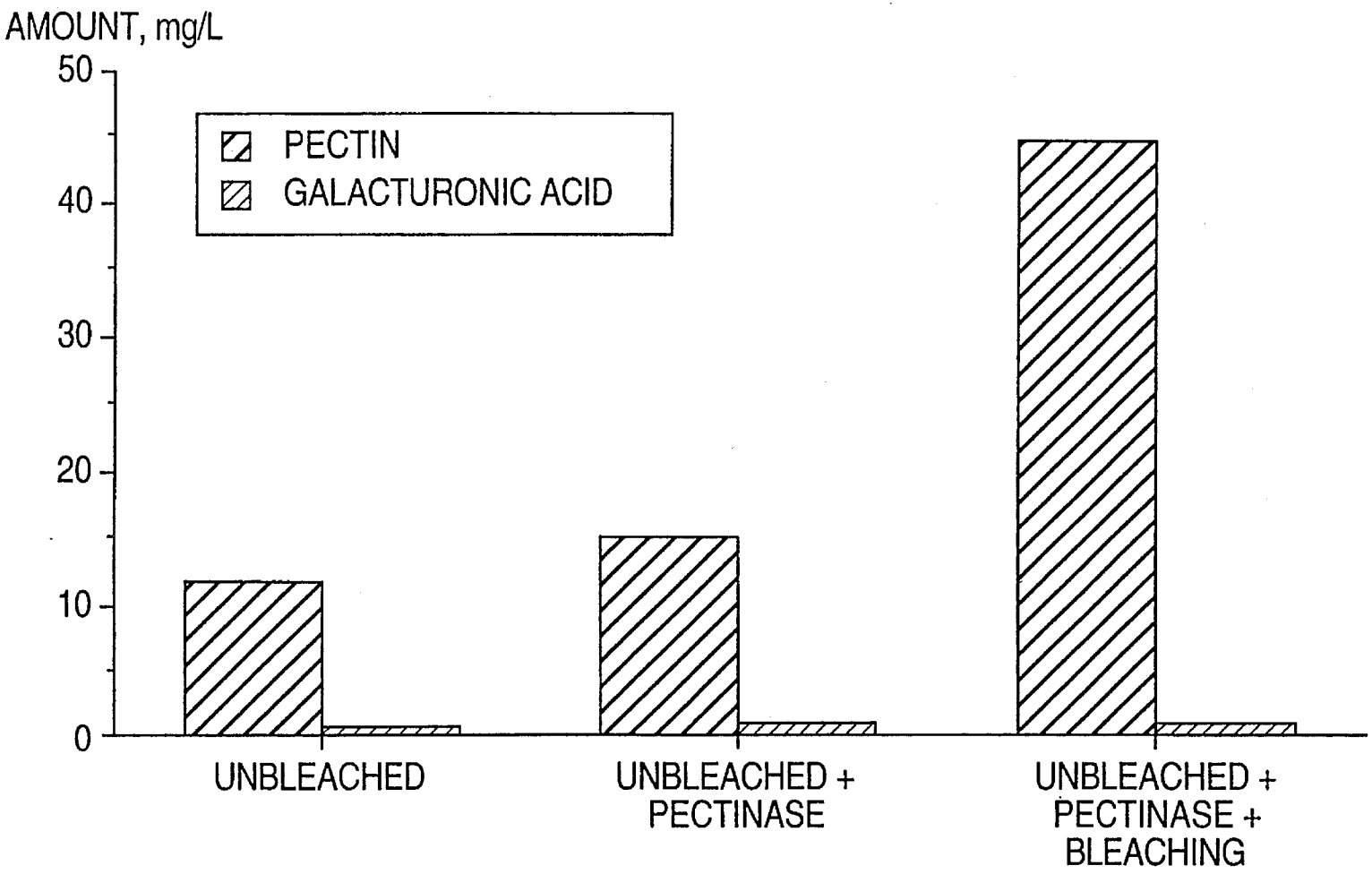
FIG. 3 illustrates the effects of treating unbleached pulp with 4% pectinase, calculated on dry pulp, prior to peroxide bleaching.

The amount of pectin and galacturonic acid in each of the three samples was evaluated. The results are shown in FIG. 3.

It can be seen that treating unbleached pulp with 4% pectinase did not substantially increase the amount of dissolved pectin and galacturonic acid. This shows that although pectin is present in unbleached pulp, it is not in the form of accessible pectin. Thus the enzyme was not capable of significantly degrading pectins present on or within the unbleached mechanical pulp fibers. Subsequent bleaching of the pectinase-treated unbleached pulp yielded mainly pectin, as also seen in the 0% pectinase treatment of the bleached pulp (FIG. 2). This shows that the pectinase added prior to bleaching was rendered ineffective in degrading pectins released during alkaline peroxide bleaching. Therefore, any pectinase treatment intended to degrade pectins released from bleached or alkaline treated pulp must be done following said bleaching or alkaline treatments.

EXAMPLE 5

Groundwood pulp bleached (peroxide/alkaline) in industrial scale was diluted to consistency of about 5%. The pulp suspension was divided into four portions. To three of these portions a pectinase (marketed under the trademark Pectinex 3X-L) was added in the following amounts: 0,001%, 0.01% and 0.1% on dry pulp. The fourth portion was not enzyme-treated. The four suspensions were then agitated for 30 min at 55° C.

Figure 4:
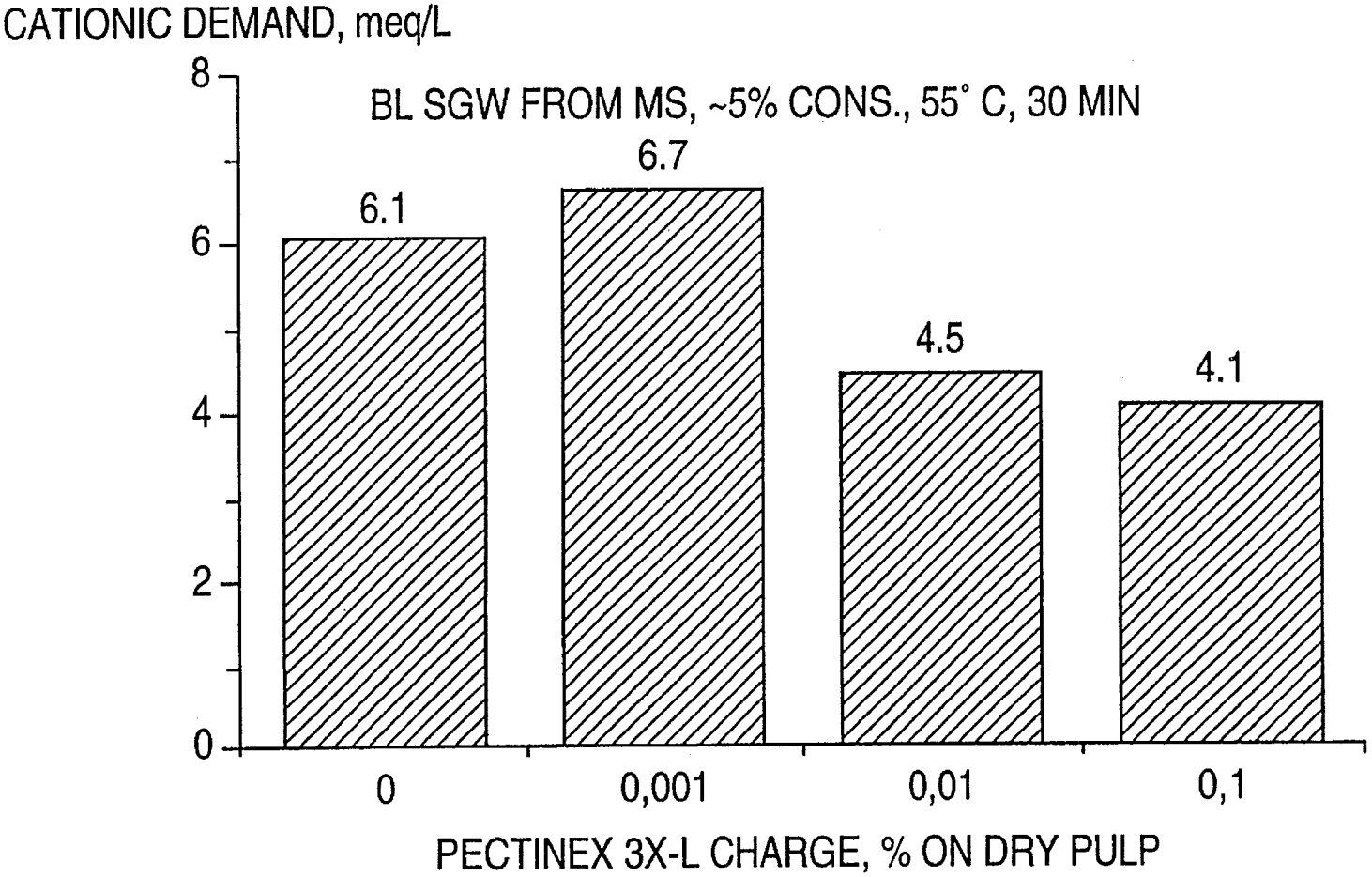
FIG. 4 shows the cationic demand of bleached pulp suspensions treated with various amounts of pectinase.

Thereafter the cationic demand was determined for each suspension as described in Example 1. The obtained results are shown in FIG. 4.

It can be seen that the cationic demand of the aqueous phase in the suspension can be decreased by about one-third if the bleached pulp is treated with 0.1% pectinase.

EXAMPLE 6

Figure 5:
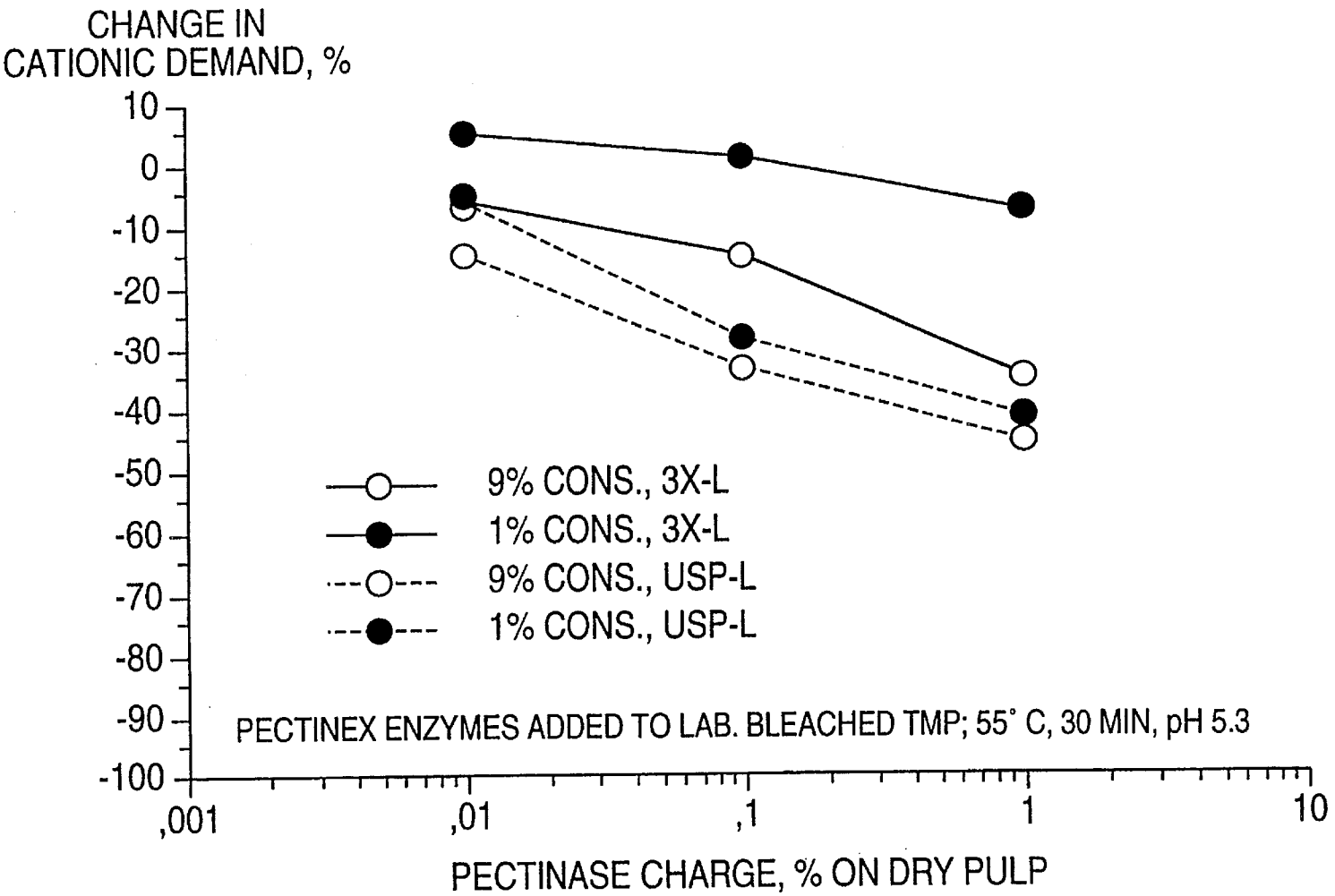
FIG. 5 shows the change in cationic demand of bleached pulp suspensions treated with various amounts of various pectinases.

Following the procedure described in Example 5 the change in cationic demand was determined for suspensions of laboratory bleached TMP (consistency 1% or 9%) treated with various amounts (0.01%, 0.1% and 1% on dry pulp) of Pectinex 3X-L or Pectinex USP-L at 55° C. for 30 min at pH 5.3. The obtained results are shown in FIG. 5.

It can be seen that the degree of pectin degradation is affected by the consistency of the pulp and the amount of charged pectinase. There are also differences in the ability to degrade pectin between different pectinase preparations. The best results were obtained for Pectinex USP-L at high pulp consistency and higher charges of the pectinase.

EXAMPLE 7

Figure 6:
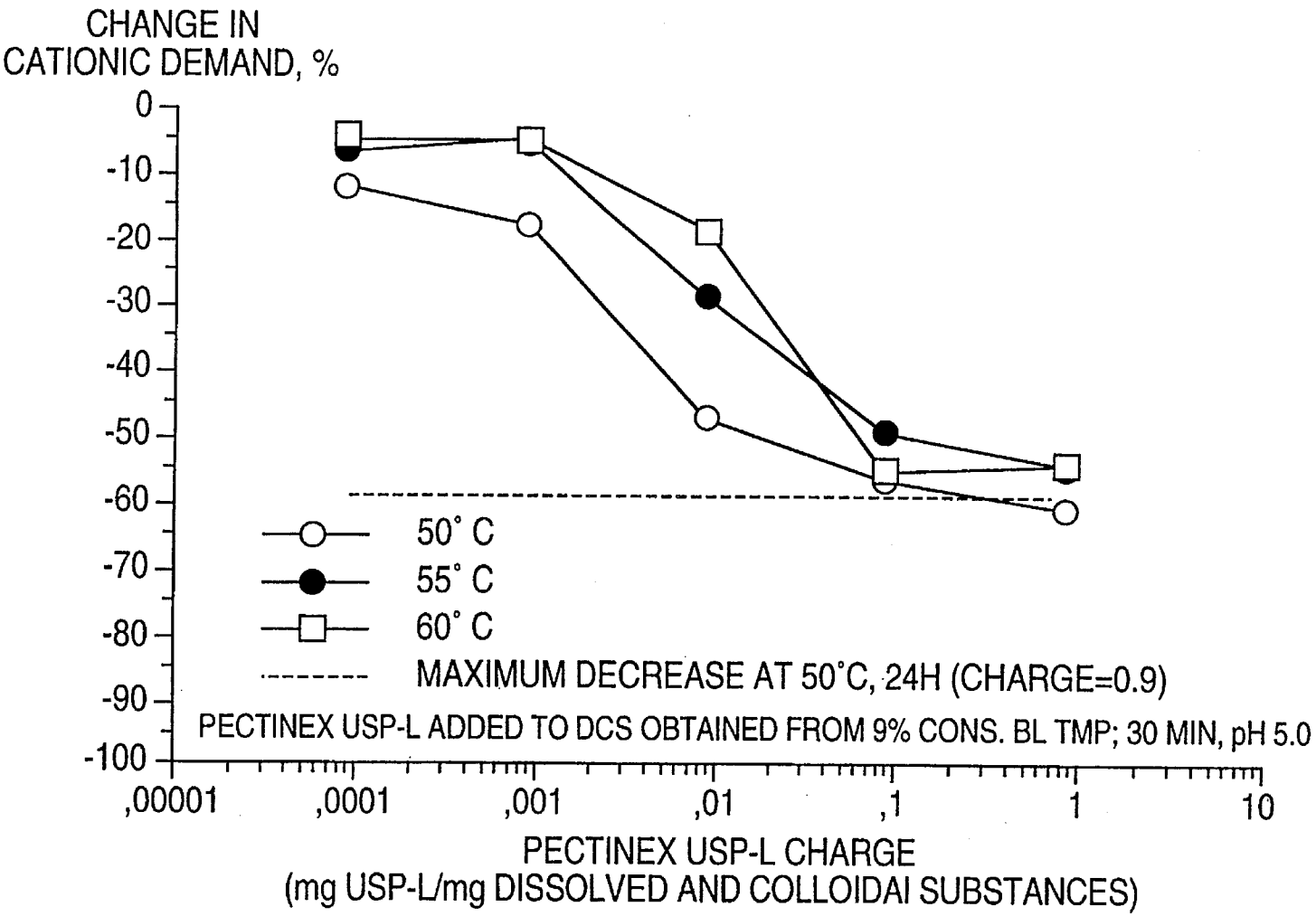
FIG. 6 shows the change in cationic demand of bleached pulp suspensions treated with various amounts of pectinase at various temperatures.

Following the procedure described in Example 5 the change in cationic demand was determined for suspensions of laboratory bleached TMP (consistency 9%) treated with various amounts of Pectinex USP-L (0.0001, 0.001, 0.01, 0.1 and 1 mg/mg dissolved and colloidal substances) at temperatures of 50° C., 55° C. and 60° C. for 30 min at pH 5.0. The results are shown in FIG. 6.

The maximum decrease in the cationic demand of about 60% was obtained at 50° C. with a Pectinex USP-L charge of 0.9. The results also show that smaller enzyme charges are needed at lower temperatures.

EXAMPLE 8

Following the procedure described in Example 5 the cationic demand for various TMP suspensions (9% consistency) was determined.

The first suspension comprised unbleached TMP.

The second suspension comprised unbleached TMP treated with Pectinex USP-L (1 kg/ton dry pulp) at 55° C., pH 5.0 for 30 min followed by 3 h stirring at 60° C.

The third suspension comprised peroxide bleached TMP.

The fourth suspension comprised peroxide bleached TMP treated with pectinex USP-L in the same manner as the second suspension.

Figure 7:
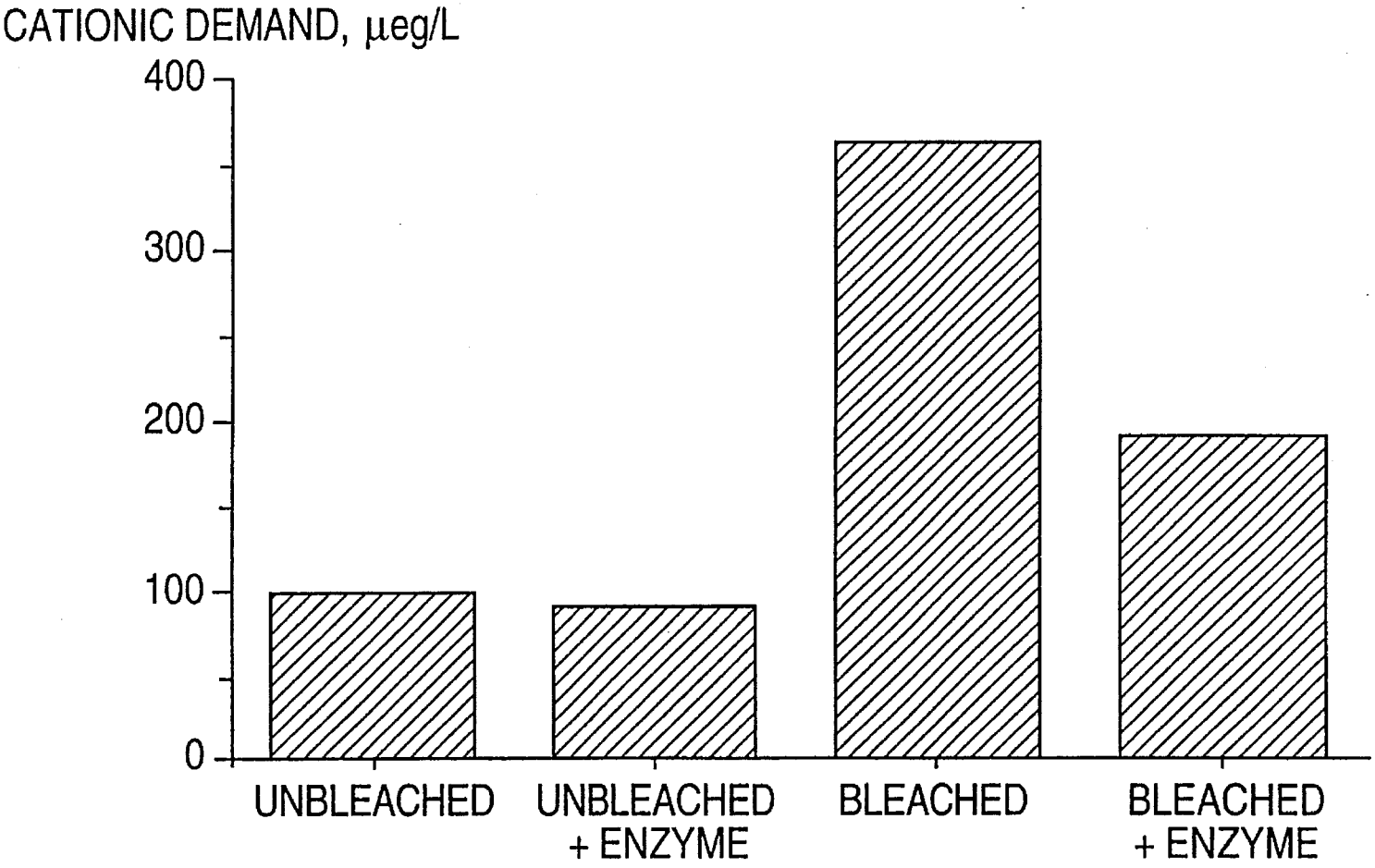
FIG. 7 shows the cationic demand of bleached and unbleached pulp suspensions before and after a treatment with pectinase.

The obtained results are shown in FIG. 7.

The results confirm that the cationic demand of the aqueous phase in a suspension of unbleached TMP is low compared to a corresponding sample of peroxide bleached (i.e. alkaline treated) TMP. The cationic demand for unbleached TMP is not significantly affected by a pectinase treatment. On the contrary, a pectinase treatment of peroxide bleached TMP decreases the cationic demand by about 50%.

Anionic trash or detrimental substances have long been blamed for decreased efficiency of retention aids because of their interaction with, or consumption of, cationic retention aids. The polygalacturonic acids (pectin) released in alkaline peroxide bleaching of Norway spruce can therefore be considered as anionic trash. By degrading the polygalacturonic acids with pectinase, rendering them inert to the cationic polymer, the efficiency of the polymer as a retention aid will increase.

Both softwoods and hardwoods contains pectins. The barks of various wood species are also known to contain pectins. Alkaline conditions of peroxide bleaching were found to be the major cause for the release of polygalacturonic acids from Norway spruce TMP. Therefore, it follows that such a release of polygalacturonic acid from mechanical pulps of other wood species would also take place in alkaline peroxide bleaching. The proposed enzyme treatment should prove to be useful in improving the efficiency of cationic retention aids in papermaking systems utilizing alkaline peroxide bleaching of mechanical pulp from many different wood and non-wood species.

We claim:

1. A method for the treatment of mechanical wood pulp in a paper making process comprising:

bleaching the mechanical wood pulp under alkaline conditions to form alkaline treated mechanical wood pulp comprising wood fibers and an aqueous phase, wherein anionic pectins are released from the fibers and become dissolved into the aqueous phase by the alkaline treatment of the fibers;

treating said alkaline treated mechanical wood pulp comprising the wood fibers and the aqueous phase containing the dissolved anionic pectins with pectinuse wherein said pectinase decomposes the dissolved anionic pectins of said aqueous phase into galacturonic acid; and subjecting the treated wood pulp to dewatering.

2. The method of claim 1, wherein the bleaching step comprises:

bleaching with peroxide.

3. The method of claim 1, in which at least one additional substance selected from the group consisting of fillers and retention aids is added to the treated wood pulp before subjecting the pulp to dewatering.

4. The method of claim 3, wherein the treating step further comprises:

allowing the pectinase to substantially degrade the anionic pectins in the aqueous phase of the alkaline treated mechanical wood pulp before adding a cationic retention aid.

5. The method of claim 1, wherein 0.4 % to 4% of pectinase, as calculated on the weight of dry pulp is employed in said treating step.

6. The method of claim 1, wherein the pectinase employed in said treating step is obtained by:

adding pectinase to water obtained from subjecting said alkaline treated pulp to dewatering; and recycling the pectinase-containing water to the treating step.

7. The method of claim 1, further comprising:

washing said alkaline treated mechanical wood pulp to form wash water and a washed pulp;

adding pectinase to said wash water; and recycling the pectinase-containing wash water to the treating step to provide said pectinase employed in said treating step.

8. The method of claim 1, wherein:

said bleaching step employs a chemical selected from the group consisting of peroxide, oxygen and sulfite.

9. A method for the treatment of mechanical wood pulp in a paper making process consisting essentially of:

bleaching a mechanical wood pulp under alkaline conditions to form wood fibers and an aqueous phase, wherein anionic pectins are released from the fibers and become dissolved into the aqueous phase by the alkaline treatment of the fibers;

treating said alkaline treated mechanical wood pulp comprising the wood fibers and the aqueous phase containing the dissolved anionic pectins with pectinuse wherein said pectinase decomposes the dissolved anioinic pectins of said aqueous phase into galacturonic acid;

adding at least one additional substance selected from the group consisting of fillers and retention aids to said treated wood pulp; and subjecting the treated wood pulp containing said at least one additional substance to dewatering.

* * * * *